US011940260B2

(12) United States Patent
Martin

(10) Patent No.: US 11,940,260 B2
(45) Date of Patent: Mar. 26, 2024

(54) DEVICE FOR DETECTING THE ABSENCE OF A MECHANICAL BARRIER FOR A MISSILE AND MISSILE COMPRISING SUCH A DEVICE

(71) Applicant: MBDA FRANCE, Le Plessis-Robinson (FR)

(72) Inventor: Edouard Martin, Le Plessis-Robinson (FR)

(73) Assignee: MBDA FRANCE (FR)

( * ) Notice: Subject to any disclaimer, the term of this patent is extended or adjusted under 35 U.S.C. 154(b) by 0 days.

(21) Appl. No.: 17/923,794

(22) PCT Filed: Mar. 26, 2021

(86) PCT No.: PCT/FR2021/050533
§ 371 (c)(1),
(2) Date: Nov. 7, 2022

(87) PCT Pub. No.: WO2021/229158
PCT Pub. Date: Nov. 18, 2021

(65) Prior Publication Data

US 2023/0184526 A1 Jun. 15, 2023

(30) Foreign Application Priority Data

May 12, 2020 (FR) ..... 2004527

(51) Int. Cl.
*F42C 15/00* (2006.01)
*F42C 15/24* (2006.01)
*F42C 15/34* (2006.01)

(52) U.S. Cl.
CPC ..... *F42C 15/34* (2013.01); *F42C 15/24* (2013.01)

(58) Field of Classification Search
CPC ..... F42C 15/34; F42C 15/24; F42C 15/00; F42C 15/21; F42C 15/20; F42C 15/30;
(Continued)

(56) References Cited

U.S. PATENT DOCUMENTS 2,704,033 A 3/1955 Koeper et al.
3,894,491 A 7/1975 Tiemann
(Continued)

OTHER PUBLICATIONS

International Search Report with English Translation and Written Opinion for PCT Application No. PCT/FR2021/050533, dated Jul. 9, 2021, pp. 1-10.

*Primary Examiner* — Michael D David
(74) *Attorney, Agent, or Firm* — Dickinson Wright PLLC

(57) ABSTRACT

A device for detecting the absence of a mechanical barrier for a missile comprises a rod constrained by a first elastic element and a free end capable of coming into contact with the mechanical barrier and a cam constrained by a second elastic element. The rod can assume one or more of the following positions: an initial entry position wherein the rod is held in a stable position between the cam and the mechanical barrier, an extended position wherein the cam moved the rod in the direction of the free end, and a final entry position wherein the rod is acted upon by the first elastic element after the rod has been released by the cam once the rod has completely entered the missile in the final entry position so as to no longer present a danger to its environment or a hindrance to the proper functioning of the missile.

20 Claims, 6 Drawing Sheets

(58) Field of Classification Search
CPC ..... F41F 3/052; F41F 3/0406; F42B 14/00; F42B 14/02; F42B 14/064; F42B 4/26
USPC ..... 102/229, 230, 237, 259, 357, 379; 89/1.816
See application file for complete search history.

(56) References Cited

U.S. PATENT DOCUMENTS 5,166,458 A * 11/1992 Yoo ..... F41A 19/45 89/147
5,834,677 A * 11/1998 Muller ..... F41A 27/30 89/41.17
5,965,837 A * 10/1999 Lee ..... F41A 9/16 89/46
2007/0283800 A1 12/2007 Park et al.

* cited by examiner

DEVICE FOR DETECTING THE ABSENCE OF A MECHANICAL BARRIER FOR A MISSILE AND MISSILE COMPRISING SUCH A DEVICE

CROSS-REFERENCE TO RELATED APPLICATION(S)

This present application is a national stage application of International Patent Application No. PCT/FR2021/050533, filed Mar. 26, 2021, which claims priority to French Patent Application No. 2004527, filed May 12, 2020, the disclosures of which are hereby incorporated by reference in their entireties.

TECHNICAL FIELD

The present invention relates to a mechanical barrier absence detection device for a missile and a missile comprising such a device.

PRIOR ART

Typically, the missiles are equipped with at least one safety and arming device DSA that allows the firing of the warhead of the missile. Typically, these safety and arming devices are equipped with a device for detecting the exit of the missile from its launch tube.

These launch tube exit detection devices comprise a detection member, usually a rod (or a finger), intended to contact the launch tube and more specifically the inner surface of the launch tube. The rod, which is movable in translation in a radial direction with respect to the missile, can assume different positions. Thus, when the rod is in contact with the launch tube, it assumes a given position and when it is no longer in contact with the launch tube it assumes another given position.

Depending on the position of the rod, it is therefore possible to determine whether or not there is an absence of a mechanical barrier; in other words, in the application to a missile, whether or not the missile has exited its launch tube.

Various devices are known to detect the exit of a missile from the launch tube, in particular:

- a first device for detecting the exit of the missile from its launch tube which comprises a removable detection member which is ejected when the missile is propelled out of its launch tube; and
- a second device for detecting the exit of the missile from its launch tube, which comprises a detection member that is held on the outer periphery of the missile after it has been propelled out of its launch tube.

Such launch tube exit detection devices have the disadvantage of having a detection member that becomes a nuisance element once the missile has exited its launch tube. Indeed:

- in the first case, the detection member is ejected with a variable power depending on the use, which may represent a danger for its immediate environment (persons or systems located in the vicinity); and
- in the second case, the detection member is not ejected but is held on the outer periphery of the missile with a protruding portion, which may represent a hindrance, in particular by creating an aerodynamic drag or by obstructing an object passing by.

These usual solutions are therefore not completely satisfactory.

Furthermore, an initiating device for a projectile, in particular a rocket, is known from the document U.S. Pat. No. 2,704,033.

SUMMARY OF THE INVENTION

The object of the present invention is to remedy the above-mentioned disadvantages by proposing a device for detecting the exit of a missile from its launch tube, and more generally a device for detecting the absence of a mechanical barrier for a missile, said device comprising at least one rod constrained by a first elastic element and provided with a free end able to come into contact with the mechanical barrier According to the invention, the device further comprises at least one cam constrained by a second elastic element, said rod and said cam being configured such that the rod can assume one or other of the following positions:

- a position referred to as initial entry, wherein the rod is held in a stable position between the cam on the one hand and the mechanical barrier on the other hand;
- a position referred to as extended, into which the rod is brought under the action of the cam by a displacement in the direction of the free end, in the absence of the mechanical barrier; and
- a position referred to as final entry, into which the rod is brought under the action of the first elastic element, after release of the displacement of the rod by the cam.

This device therefore avoids all the nuisances that can be caused by the rod, as described above. In effect, when the rod is in the final entry position, it is in a position specified later where it no longer presents a danger to its surroundings or a hindrance to the proper functioning of the missile, as specified above.

Furthermore, advantageously, the mechanical barrier absence detection device comprises at least one activatable detection element, configured to be activated when the rod assumes the final entry position.

Furthermore, in a particular embodiment, the detection element is activated by the rod or the cam, when said rod assumes the final entry position. In another embodiment, the mechanical barrier absence detection device comprises an additional cam, referred to as auxiliary cam, secured to said cam and the detection element is configured to be activated by said auxiliary cam.

In a particular embodiment of the foregoing, the mechanical barrier absence detection device comprises at least one elastically constrained initiating finger and an aperture embodied on a peripheral portion of the auxiliary cam, said initiating finger is part of the detection element and said initiating finger and said aperture are configured and positioned such that the initiating finger is housed in the aperture when the rod assumes the final entry position.

Furthermore, in a particular embodiment, the mechanical barrier detection device comprises at least one sealing element arranged at the free end of the rod and a hub comprising a bore adapted to receive said sealing element when said rod assumes the final entry position.

This configuration makes the missile impervious to a vast majority of impurities that it is likely to encounter during its trajectory.

The present invention also relates to a missile. According to the invention, said missile comprises at least one mechanical barrier absence detection device as described above.

In a first embodiment, the missile comprises a launch tube exit detection device and a chain for initiating the warhead of said missile, said launch tube exit detection device corresponding to said mechanical barrier absence detection device described above.

In a particular embodiment of this first embodiment, the missile comprises an initialization chain of a warhead and a mechanical barrier absence detection device comprising at least one elastically constrained initiating finger as described above, said initiating finger being capable of triggering the initialization chain when it is housed in the aperture provided for that purpose in the auxiliary cam.

In a second embodiment, alternatively or in addition to said first embodiment, the missile comprises a holding system which comprises at least one launch tube exit detection device as aforesaid and at least one holding element arranged at the free end of the rod of said at least one of said devices, said holding element being adapted to come into contact with the mechanical barrier.

Furthermore, in a particular embodiment of this second embodiment, the missile comprises a holding system comprising a single holding element and a plurality of mechanical barrier absence detection devices, such as the one described above, the end of each of said devices being connected to said holding element.

Advantageously, the missile may comprise a plurality of holding systems.

In a first embodiment of the above-described embodiment, the holding element corresponds to a strip.

In a second embodiment of the foregoing embodiment, the holding element corresponds to a pad.

Furthermore, in a particular embodiment, the missile comprises at least one gorge adapted to receive the holding element when the rod of the mechanical barrier absence detection device or devices assume the final entry position.

Thus, the missile has a launch tube exit detection device capable of triggering the retraction or the deployment of holding or guiding elements, such as strips or pads, so that the various elements do not hinder the proper functioning of said missile when it exits the launch tube.

BRIEF DESCRIPTION OF FIGURES

The figures of the attached drawing will make it clear how the invention can be realized. In these figures, identical references designate the similar elements.

DETAILED DESCRIPTION

Figure 1:
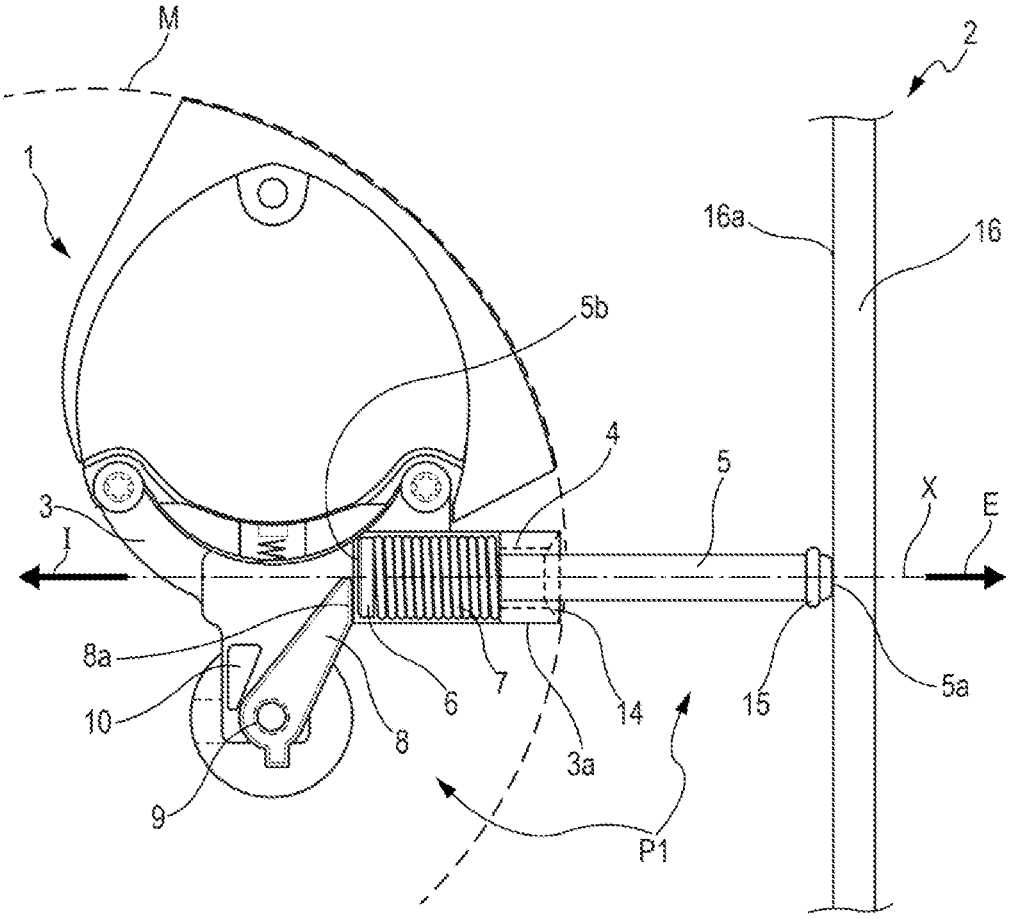
FIG. 1 schematically illustrates an example of a mechanical barrier absence detection device comprising a rod that assumes an initial entry position.

The purpose of the device 1, shown schematically in FIG. 1 and used to illustrate the invention, is to detect the absence of a mechanical barrier 2, which may be any solid surface. This device 1 is intended to be installed on a missile M, and in this case the mechanical barrier 2 is preferably the launch tube 16 of said missile M.

A missile is any self-propelled flying object that can be guided along all or a portion of its trajectory, by self-guidance or remote-controlling, and is capable of carrying at least one warhead, in particular explosive or pyrotechnic. This could include in particular an anti-tank missile, fired from a helicopter or a drone. It can also have a medium-range missile, fired from the ground.

The device 1 comprises a support element, referred to as hub 3, which comprises, in particular, usual attachment elements (not shown) configured to attach said device 1 to the missile M. The hub 3 may also be attached directly to the warhead of the missile M. This hub 3 is provided with an angled portion 3*a* comprising at least one aperture suitable for receiving at least one bearing element 4. The latter is intended to receive at least one rod 5, said rod 5 being slidable in said bearing element 4.

Figure 6:
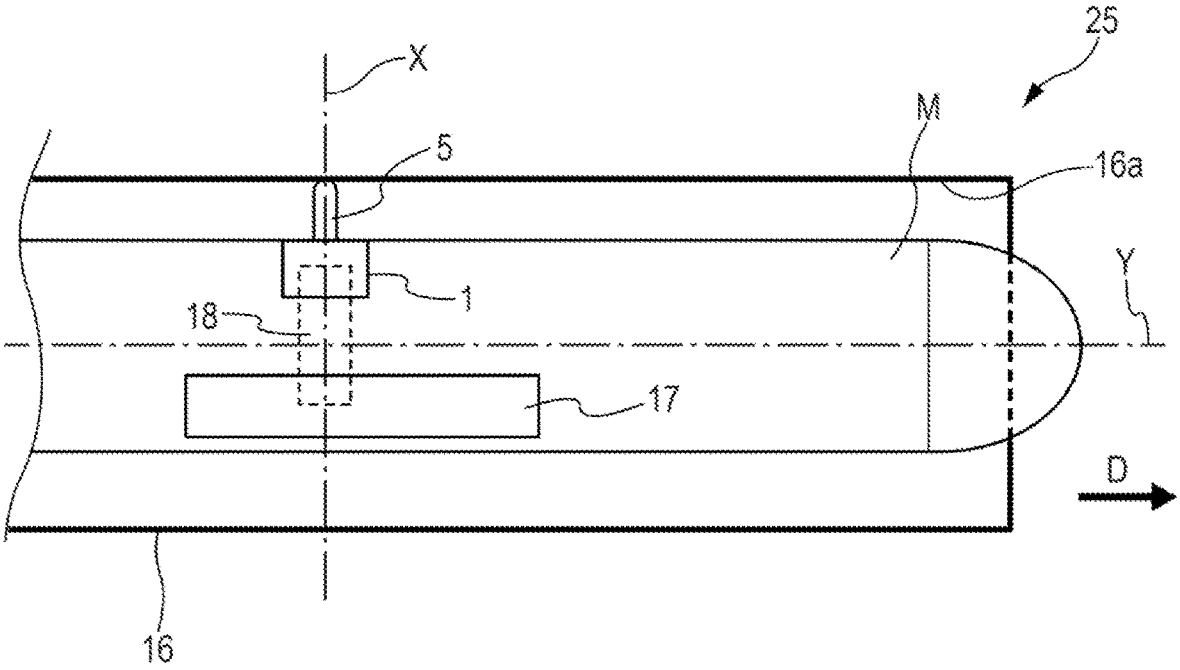
FIG. 6 illustrates schematically an example of a missile in its launch tube, comprising a device for detecting the absence of mechanical barrier.
Figure 7:
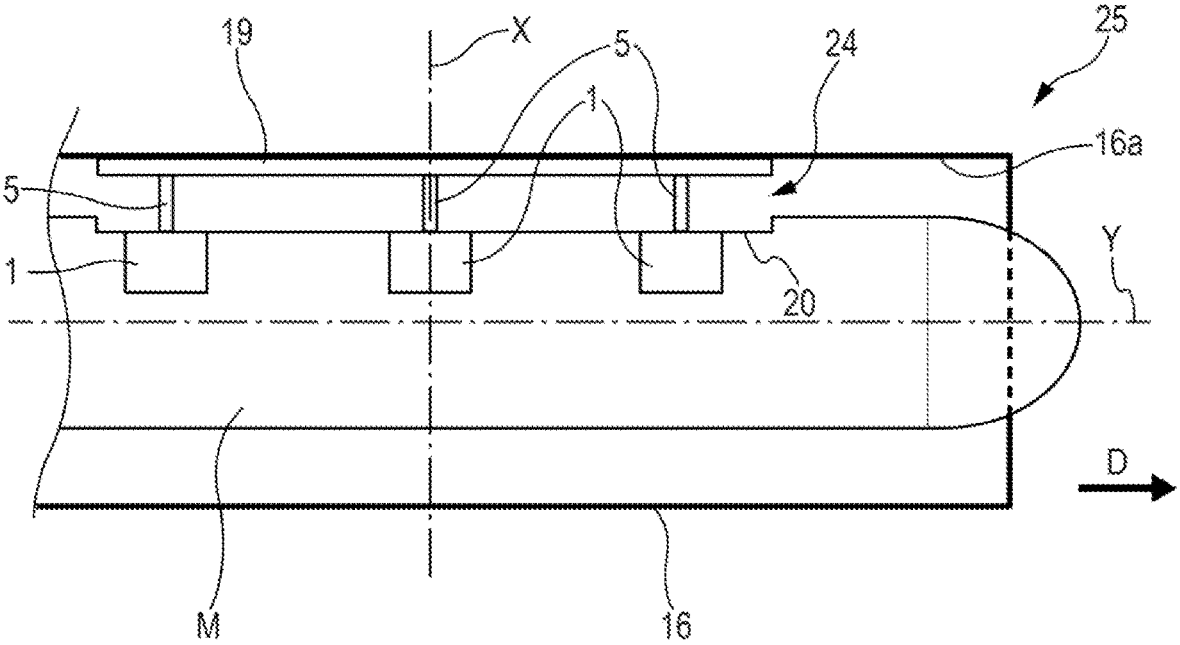
FIG. 7 illustrates schematically an example of missile in its launch tube, comprising a holding system.

The rod 5 has a longitudinal axis, noted X, and the missile M has a longitudinal axis, noted Y (FIGS. 6 and 7). The device 1 is positioned on the missile M so that the axis X is oriented radially to the axis Y.

Figure 2:
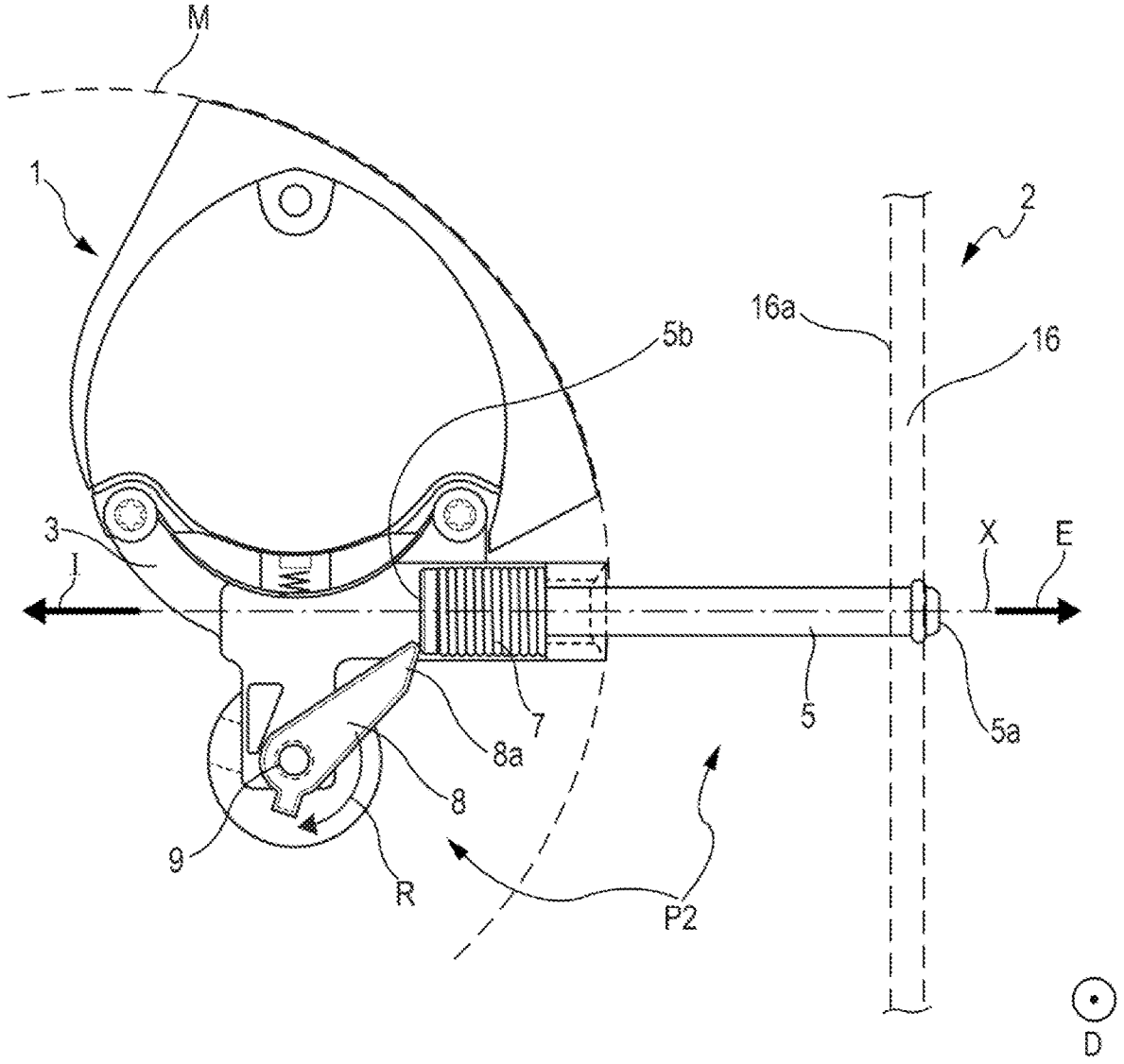
FIG. 2 schematically illustrates the example of the mechanical barrier absence detection device of FIG. 1, in which the rod assumes an extended position.
Figure 3:
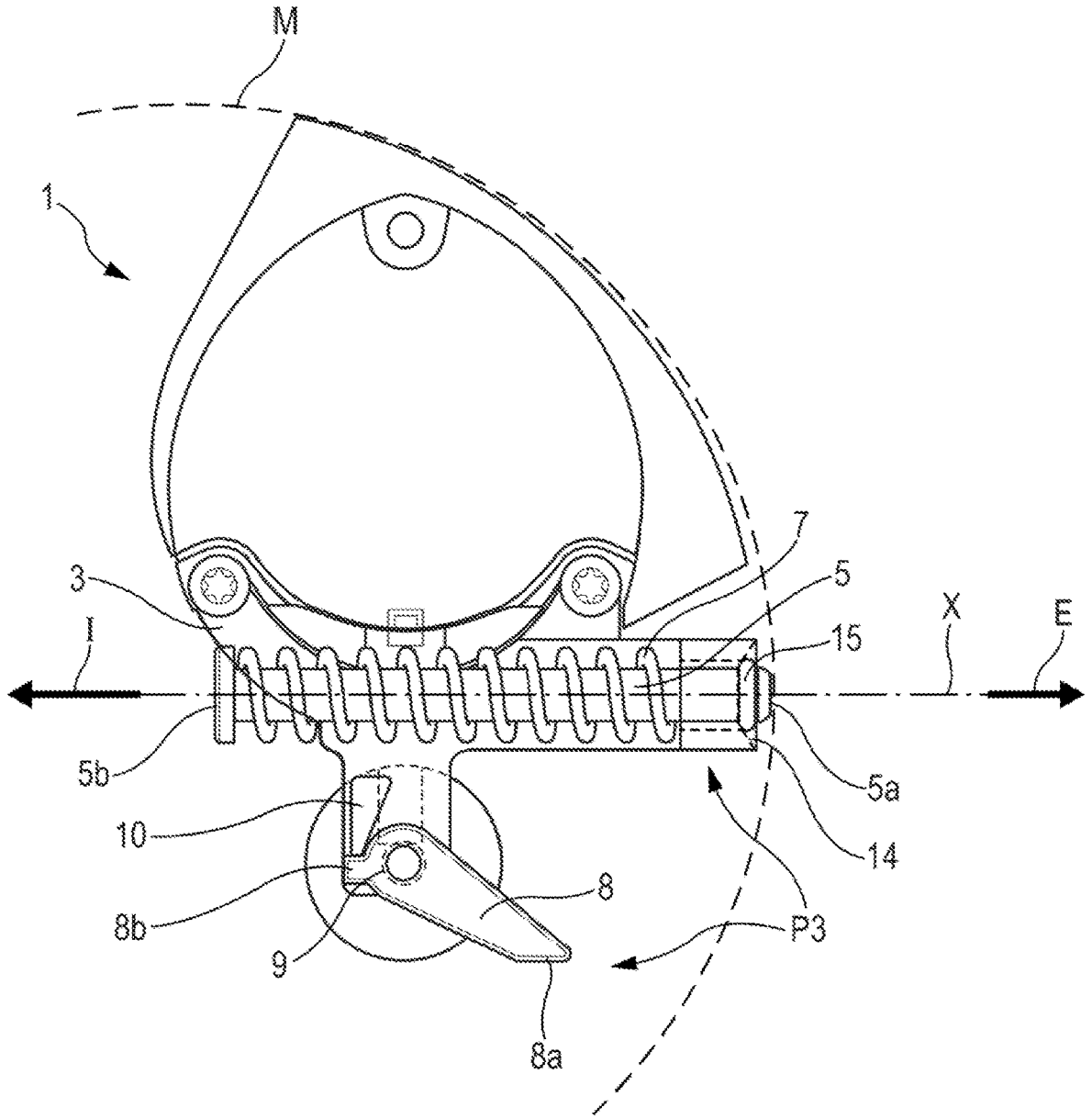
FIG. 3 schematically illustrates the example of the mechanical barrier absence detection device of FIG. 1, in which the rod assumes a final entry position.

In addition, the rod 5 has two ends:

- an end 5*a*, referred to as free, oriented along the axis X in the direction illustrated by an arrow E in FIGS. 1 to 3 in particular, towards the outside of the missile M and able to come into contact with the mechanical barrier 2; and
- an end 5*b*, oriented along the axis X in the direction illustrated by an arrow I, towards the interior of the missile M.

In addition, the device 1 also comprises an elastic element 7 intended to elastically constrain the rod 5 relative to the hub 3. For this purpose, the rod 5 comprises a neck 6 at its end 5*b*. In addition, the angled portion 3*a* is provided with a flat surface parallel to the neck 6, suitable for receiving the elastic element 7. The elastic element 7 is arranged around the rod 5 in such a way that it rests on the neck 6 on the one hand and on the flat surface of the angled portion 3*a* on the other hand. The elastic element 7 is thus compressed between the neck 6 and the angled portion 3*a*. As a result, the rod 5 is elastically constrained in translation along the axis X, with the elastic element 7 exerting a force on said rod 5 in the direction illustrated by the arrow I.

The device 1 also comprises at least one cam 8, pivotally connected to the hub 3. This cam 8 is torsionally constrained with respect to the hub 3 by an elastic element 9, shown in dotted lines in FIGS. 1, 2 and 3. The elastic element 9 is configured to exert a torque on the cam 8, oriented in the direction indicated by an arrow R in FIG. 2. In addition, the cam 8 has a free end 8*a* which is adapted to come into contact with the end 5*b* of the rod 5. The dimensions and the shape of the cam 8 are such that the surface 8*a* of said cam 8 comes into contacts with the surface of the end 5*b* of the rod 5 when the cam 8 pivots about its axis in the direction of the arrow R. The cam 8 is thus configured to exert a force on the rod 5 in the direction illustrated by the arrow E.

The hub 3 also comprises a protruding element forming a stop 10 (FIGS. 1 and 3). In addition, the cam 8 is equipped with a protruding element 8*b* adapted to come into contact with the stop 10 when the cam 8 pivots about its axis in the direction indicated by the arrow R. The shape 8*b* is configured on the cam 8 such that said cam 8 is rotationally locked by the stop 10 when it assumes a position described below.

In a preferred embodiment, the device 1 is intended to detect the exit of the missile M from the launch tube 16. The method for detecting the exit of the missile M from the launch tube 16 is implemented in three steps, with different elements of the device 1, in particular the rod 5 and the cam 8, taking a given position for each of these steps. FIGS. 1, 2 and 3 illustrate, respectively, the three given positions P1, P2 and P3 in succession.

In position P1, referred to as initial entry position shown in FIG. 1, the missile M is installed in the launch tube 16. The rod 5, pushed by the cam 8, is in contact with the mechanical barrier 2, namely the inner wall 16*a* of the launch tube 16. In this position, the rod 5 is elastically constrained by the elastic element 7 in the direction illustrated by the arrow I, and by the elastic element 9, via the cam 8, in the direction illustrated by the arrow E. However, the elastic element 9 is configured to exert a greater force on the rod 5 via the cam 8 than the elastic element 7 exerts on the rod 5. The rod 5 is thus forced against the mechanical barrier 2 and takes up a stable position between the cam 8 and the mechanical barrier 2.

In the position P2, referred to as the extended position and shown in FIG. 2, at least one portion of the missile M comprising the device 1 has just been propelled out of the launch tube 16. There is therefore a relative displacement of the missile M with respect to the launch tube 16, as illustrated by an arrow D. The launch tube 16 is shown dashed in FIG. 2 to indicate that it is not in the same plane as the rest of FIG. 2. The rod 5 is therefore no longer in contact with the mechanical barrier 2. The mechanical barrier 2 no longer blocks the rod 5 in translation, and the cam 8 therefore forces the displacement of said rod 5 in the direction illustrated by the arrow E, by pivoting around its axis in the direction illustrated by the arrow R.

Once the cam 8 has pushed the rod 5 into position P2, said cam 8 continues to pivot until it reaches the stop 10. However, the cam 8 is configured to release the translation of the rod 5 after said cam 8 has pivot in the direction of the arrow R, beyond the position P2. As the rod 5 is no longer subjected to the force of the cam 8, the elastic element 7 forces said rod 5 to displace in the direction illustrated by the arrow I. The rod 5 then enters the missile M completely, and is brought to the position P3, referred to as final entry position, shown in FIG. 3.

In this position P3, the rod 5 does not protrude outwards from the missile M and does not present any hindrance. Furthermore, a device 1 as described above does not eject any parts during its use, as the rod 5 is retracted into the missile M after the latter has exited the launch tube 16.

Furthermore, said device 1 is autonomous, as it does not require the use of an energy source such as a power supply or a pyrotechnic device. Only the mechanical energy supplied by the elastic elements 7 and 9 is necessary to set in motion the various elements of the device 1 that generate the retraction of the rod 5.

Figure 4A:
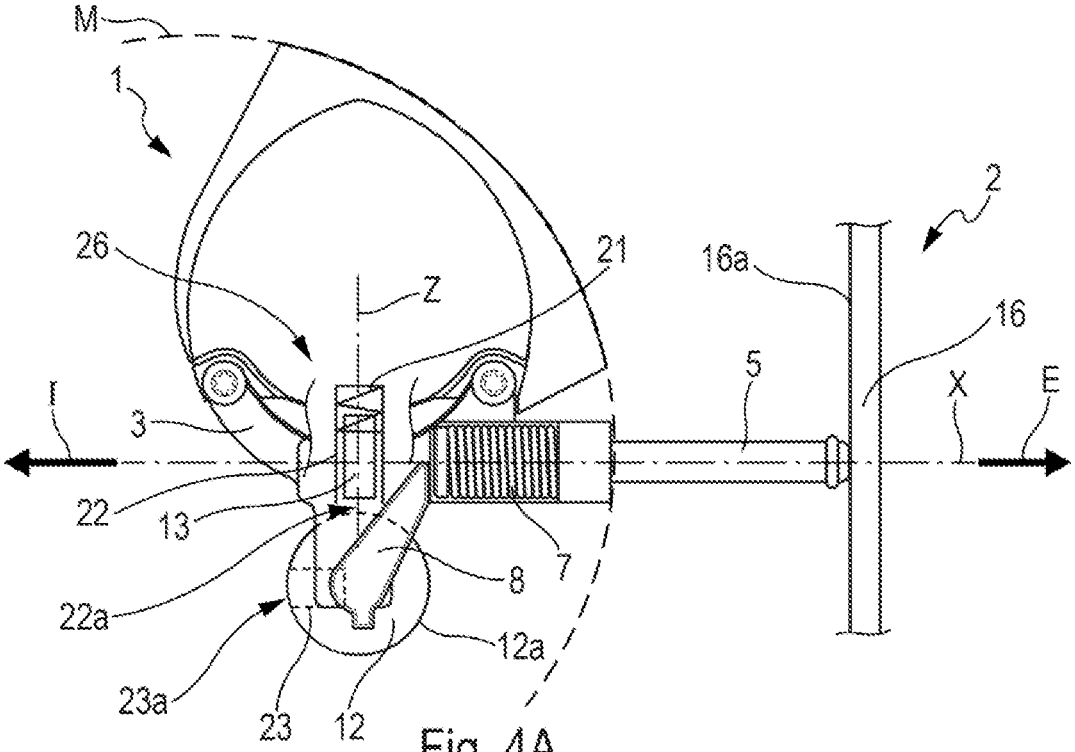
FIGS. 4A and 4B schematically illustrate an example of a mechanical barrier absence detection device comprising a detection element which is an initiating finger, with the rod assuming the initial entry position and the final entry position respectively.
Figure 4B:
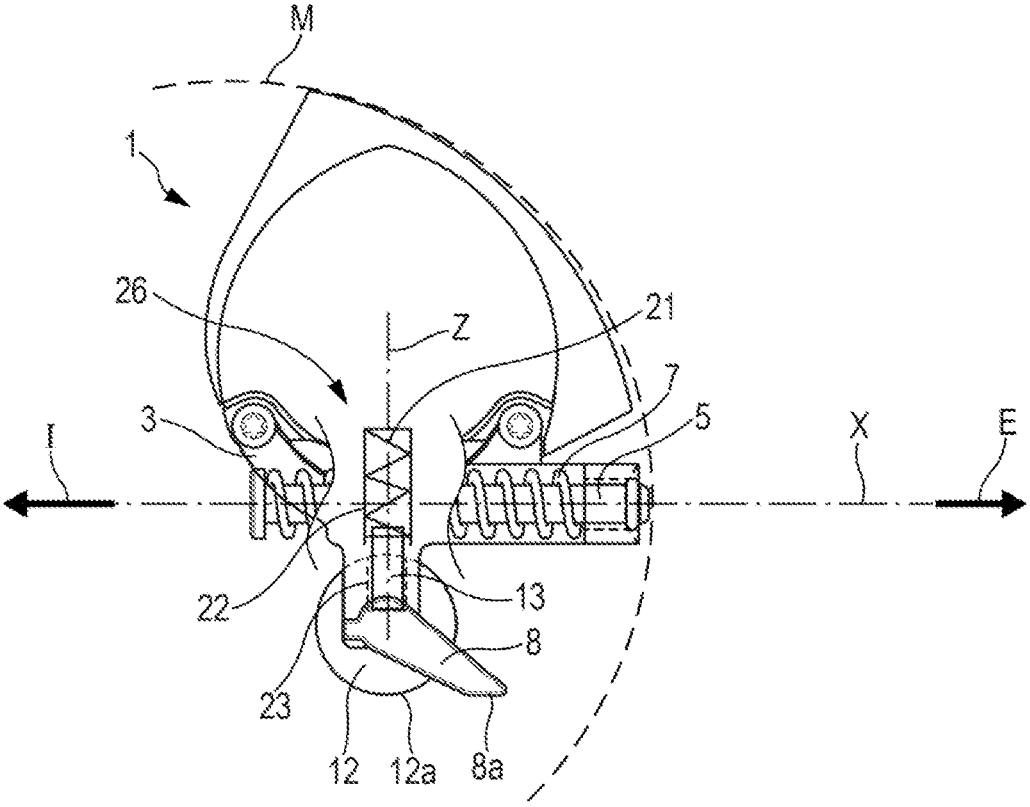

In a preferred embodiment, shown in more detail in FIGS. 4A and 4B, the device 1 comprises an additional cam, referred to as auxiliary cam 12. This auxiliary cam 12 is secured to the cam 8, for example via an axle, and is therefore able to pivot relative to the hub 3 with said cam 8.

Furthermore, in this preferred embodiment, the device 1 comprises a detection element 26, and an initiating finger 13 with longitudinal axis Z which forms part of this detection element 26. The initiating finger 13 is housed in a blind hole 22, said hole 22 being embodied into the hub 3. This hole 22 is formed and located such that the aperture 22*a* (or mouth) of the blind hole 22 faces a peripheral surface 12*a* of the auxiliary cam 12. Furthermore, an elastic element 21, for example a compression spring, is positioned at the bottom of the hole 22 so as to exert a force on the end of the initiating finger 13, in the direction from the bottom of the hole 22 towards the aperture 22*a* of said hole 22. In this way, the initiating finger 13 is elastically constrained by the elastic element 21 against the peripheral surface 12*a* of the auxiliary cam 12.

Furthermore, the auxiliary cam 12 comprises an aperture 23, for example also a blind hole, on the peripheral surface 12*a*. This aperture 23 is shaped and located so that its mouth 23*a* faces the aperture 22*a* so that the aperture 23 is able to receive the initiating finger 13, when the auxiliary cam 12 pivots in the direction illustrated by the arrow R and takes a given position. This given position corresponds to the situation where the elements of the device 1 assume the position P3 when the missile M is extended from the launch tube 16.

Furthermore, in a preferred embodiment, the missile M is provided with a warhead 17 and an initialization chain 18 of said warhead 17, shown in FIG. 6. The initiating finger 13 is configured to be able to trigger the initialization chain 18 when it slides into the aperture 23.

With the initiating finger 13, the device 1 is able to trigger the initialization chain 18 of a warhead 17 of a missile M in case the mechanical barrier 2 is absent.

Furthermore, the production of the initiating finger 13, as described above, has the advantage of allowing a high degree of flexibility in the positioning of said initiating finger 13 with respect to the auxiliary cam 12. Indeed, the initiating finger 13 can assume a plurality of angular positions around the axis of rotation of the auxiliary cam 12. The plane of the initiating finger 13, defined by the axes X and Z, may also take on a plurality of angular orientations with respect to the plane orthogonal to the axis Y of the missile M. Indeed, depending on the position and the orientation of the initiating finger 13, the shape of the auxiliary cam 12 may be configured so that the peripheral surface 12*a* faces the initiating finger 13. Furthermore, instead of being made in a simple cylindrical shape, as shown in the example of FIGS. 4A and 4B, the auxiliary cam 12 can be realized with a shape of a truncated cone and thus allow the initiating finger 13 to be oriented at a given angle relative to the plane orthogonal to the axis Y.

Such a flexibility in the positioning of the initiating finger 13, which corresponds to a means of detecting the absence of a mechanical barrier, allows the implementation of the device 1 on a wide range of missiles. This flexibility also allows a greater freedom in the arrangement of the warhead or warheads 17 (FIG. 6) and their initialization chain 18 (FIG. 6) on the missile M.

Figure 5:
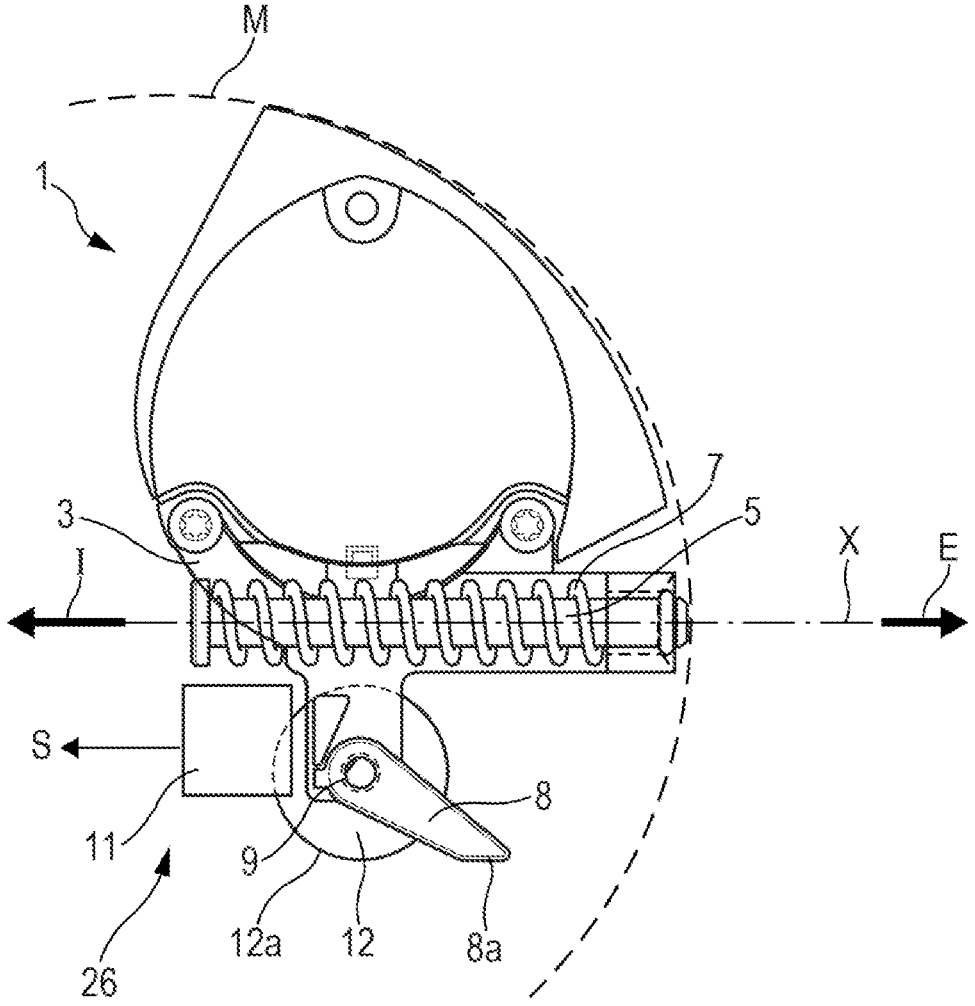
FIG. 5 shows schematically an example of a mechanical barrier absence detection device comprising a detection element.

In a particular embodiment, as an alternative to the previous embodiment, the detection element 26 comprises a detection means 11 shown very schematically in FIG. 5. The detection means 11 is activatable and is configured to emit a signal S when the elements of the device 1 assume the position P3. The signal S may correspond, in particular, to a mechanical command capable of triggering an initialization chain for a warhead, or the deflection of elements of the missile M, such as usual wing elements or deflectors (or even the closing of an electrical circuit due to the rotation of the cam 8 or the translation of the finger 5).

In a first embodiment of the foregoing embodiment, the detection element 26 is configured to be activated by the rod 5 when the latter assumes the position P3. The rod 5 is, for example, provided with a protruding portion or an insert (not shown in FIG. 5) capable of activating the detection element 26.

In a second embodiment of the foregoing embodiment, the detection element 26 is configured to be activated by the cam 8 when the rod 5 assumes the position P3. The cam 8 is, for example, provided with a protruding portion or an aperture located on its periphery (such as, in particular, the aperture 23 shown in FIGS. 4A and 4B) capable of activating the detection element 26.

Furthermore, in a third embodiment of the foregoing embodiment, the detection element 26 is configured to be activated by the auxiliary cam 12 when the latter assumes the position P3. The auxiliary cam 12 is, for example, provided with a protruding portion or an aperture located on its periphery, such as the aperture 23 shown in FIGS. 4A and 4B, suitable for activating the detection element 26.

The detection element 26, whether in the embodiment with the initiating finger 13 associated with the aperture 23 or in the more general embodiment of the detection means 11, has the advantage of decoupling the (possible) motions of the detection element 26 from (possible) parasitic motions of the mechanical barrier 2. This is because the mechanical barrier 2 can, for example, transmit vibrations or shocks to the rod 5 when the missile M is mounted in the launch tube 16. These motions are only transmitted to the cam 8 (and possibly to the auxiliary cam 12), but not to the detection element 26 (such as the initiating finger 13). This has the effect of preventing, in particular, damage to the detection element 26, or false detection by the latter and thus (in the extreme case) an untimely triggering of the warhead 17 of the missile M.

In another embodiment, in addition to the previous embodiments and shown in the examples of FIGS. 1, 2 and 3, the angled portion 3*a* of the hub 3 comprises a bore 14 on its face oriented in the direction illustrated by the arrow E. In addition, the rod 5 is provided, at its free end 5*a*, with a sealing element 15, for example an O-ring. The bore 14 is configured to accommodate the sealing element 15. Thus, when the rod 5 assumes the position P3, the sealing element 15 is housed in the bore 14.

The sealing element 15 thus prevents liquid or dust from entering the missile M. This embodiment also allows to dampen any possible rebound of the rod 5, during the retraction, and also to limit the vibrations of said rod 5 when it is in position P3.

The device 1, as described above, is thus intended to be mounted on a missile M. In this case, the device 1 is preferably a device for detecting the exit of the missile 1 from its launch tube 16. It may also be a device for detecting the absence of another element, in particular a support, for example a rail intended to receive or carry the missile M while awaiting its firing.

FIGS. 6 and 7 illustrate two examples of a weapon system 25. The weapon system 25 comprises the missile M equipped with at least one device 1, the launch tube 16, and all usual means of propulsion and launch of such a missile M, said usual means not being shown in FIGS. 6 and 7.

The examples in FIGS. 6 and 7 show, respectively, two particular embodiments of a weapon system 25 provided with the missile M In the first embodiment, illustrated schematically in FIG. 6, the weapon system 25 thus comprises, in particular, the missile M equipped with a device 1, as well as the warhead 17 and the initialization chain 18 capable of triggering said warhead 17.

When the missile M is propelled out of the launch tube 16, various elements of the device 1 assume the position P3, as described above, and activate the detection element 26 (not shown in FIG. 6). The element 11 in turn activates the initialization chain 18, thereby initiating the warhead 17 of the missile M.

In a preferred embodiment of this embodiment, the initiating finger 13 (not shown in FIG. 6) forms part of the detection element 26. In this case, the initialization chain 18 of the warhead 17 of the missile M is activated by the initiating finger 13 (which operates as described above with reference to FIGS. 4A and 4B).

Furthermore, in the second embodiment, as an alternative or in addition to said first embodiment, which is illustrated schematically in FIG. 7, the weapon system 25 comprises, in particular, a missile M equipped with a holding system 24. This holding system 24 comprises at least one device 1, and at least one holding element 19 arranged at the end 5*a* of the rod 5 and capable of coming into contact with the inner wall 16*a* of the launch tube 16.

When the missile M is installed in the launch tube 16, the holding element 19 is pressed against the inner wall 16*a* of the launch tube 16. As soon as the missile M is propelled out of the launch tube 16, various elements of the device 1 assume the position P3. The rod 5 then enters the missile M completely, taking the holding element 19 with it.

In a particular embodiment of the foregoing embodiment, shown in FIG. 7, the holding element 19 corresponds to a strip. By strip is meant a longitudinal element capable of coming into contact with the inner wall 16*a* of the launch tube 16 for the purpose of doing a functional action for the missile M, such as a guiding action during the propulsion of said missile M. For example, the inner wall 16*a* of the launch tube 16 may be provided with usual support or guiding elements such as grooves, tongues, or guiding fingers, suitable for receiving the strip to form a guiding system.

Preferably, the holding system 24 comprises a plurality of holding elements 19 distributed for example around the external face of the missile M. Thus, the holding system 24 can guide the missile M out of the launch tube 16 during the propulsion phase, and the holding element or elements 19 are retracted into the missile M after said missile M exits said launch tube 16.

Furthermore, for each holding element 19, the missile M is provided, on its peripheral surface, with a gorge 20 suitable for receiving said holding element 19 so that the latter does not protrude from said missile M in the retracted position.

The missile M thus has a retractable holding system 24 in the gorge 20 when said missile M is extended from the launch tube 16, and comprising no protruding element likely to represent a hindrance to the proper operation of said missile M.

In another particular embodiment (not shown) of the above embodiment, the holding element corresponds to a pad. A pad is defined as one or more elements of variable shape and size, generally made of elastic material, intended, in particular, to hold the missile M or a portion of the missile M in place in a damped manner, and thus to protect it from shocks. Such a holding system corresponds to a damping system and is retractable, in the same way as in the previous embodiment.

The invention claimed is:

1. A device for detecting an absence of a mechanical barrier for a missile, the device comprising:

at least one rod constrained by a first elastic element and provided with an end referred to as free capable of coming into contact with the mechanical barrier, and at least one cam constrained by a second elastic element, the rod and the cam being configured so that the rod can assume one of the following positions:

a position referred to as an initial entry position (P1), wherein the rod is held in a stable position between the cam and the mechanical barrier;

a position referred to as an extended position (P2), into which the rod is brought under an action of the cam by a displacement in a direction (E) of a free end, in the absence of the mechanical barrier; and a position referred to as a final entry position (P3), into which the rod is brought under an action of the first elastic element, after release of the displacement of the rod by the cam.

2. The device according to claim 1, wherein at least one activatable detection element is configured to be activated when the rod assumes the final entry position (P3).

3. The device according to claim 2, wherein the at least one activatable detection element is configured to be activated by one of the following elements:

the rod; and the cam.

4. The device according to claim 2, further comprising an additional cam, referred to as an auxiliary cam, secured to the cam, wherein the at least one activatable detection element is configured to be activated by the auxiliary cam.

5. The device according to claim 4, further comprising:

at least one elastically constrained initiating finger; and an aperture embodied on a peripheral portion of the auxiliary cam, wherein the initiating finger forms part of the at least one activatable detection element, wherein the initiating finger and the aperture are configured and positioned so that the initiating finger is housed in the aperture when the rod assumes the final entry position (P3).

6. The device according to claim 1, further comprising:

at least one sealing element arranged at the free end of the rod; and a hub comprising a bore capable of receiving the sealing element when the rod assumes the final entry position (P3).

7. A missile (M), comprising at least one device for detecting an absence of a mechanical barrier for the missile (M), each of the at least one device comprising:

at least one rod constrained by a first elastic element and provided with an end referred to as free capable of coming into contact with the mechanical barrier, and at least one cam constrained by a second elastic element, the rod and the cam being configured so that the rod can assume one of the following positions:

a position referred to as initial entry (P1), wherein the rod is held in a stable position between the cam and the mechanical barrier;

a position referred to as extended (P2), into which the rod is brought under an action of the cam by a displacement in a direction (E) of a free end, in the absence of the mechanical barrier; and a position referred to as final entry (P3), into which the rod is brought under an action of the first elastic element, after release of the displacement of the rod by the cam.

8. The missile (M) according to claim 7, wherein the missile (M) comprises a launch tube exit detection device and an initialisation chain for a warhead, wherein the launch tube exit detection device corresponds to the at least one device.

9. The missile according to claim 8, wherein an initiating finger is adapted to trigger the initialisation chain of the warhead of the missile (M), when it is housed in an aperture of an auxiliary cam.

10. The missile according to claim 7, comprising:

at least one holding system, comprising the at least one device; and at least one holding element arranged at the free end of the rod of the at least one device, the at least one holding element being able to come into contact with the mechanical barrier.

11. The missile according to claim 10, wherein the at least one holding system comprises one of the at least one holding element and a plurality of the at least one device, the free end of the rod of each of the at least one device being connected to the holding element.

12. The missile according to claim 10, further comprising a plurality of holding systems.

13. The missile according to claim 10, further comprising at least one gorge capable of receiving the at least one holding element when the rod of the at least one device assumes the final entry position (P3).

14. The missile according to claim 10, wherein the at least one holding element corresponds to a strip.

15. The missile according to claim 10, wherein the at least one holding element corresponds to a pad.

16. The missile (M) according to claim 8, wherein the at least one device further comprises:

an additional cam, referred to as an auxiliary cam, secured to the cam, wherein a detection element is configured to be activated by the auxiliary cam;

at least one elastically constrained initiating finger; and an aperture embodied on a peripheral portion of the auxiliary cam, wherein the initiating finger forms part of the detection element, wherein the initiating finger and the aperture are configured and positioned so that the initiating finger is housed in the aperture when the rod assumes the final entry position (P3), wherein at least one activatable detection element is configured to be activated when the rod assumes the final entry position (P3), and wherein an initiating finger is adapted to trigger the initialisation chain of the warhead of the missile (M), when it is housed in the aperture of the auxiliary cam.

17. The missile according to claim 8, comprising at least one holding system, wherein the at least one holding system comprises the at least one device and at least one holding element arranged at the free end of the rod of the at least one device, the at least one holding element being able to come into contact with the mechanical barrier.

18. The missile according to claim 9, comprising:

at least one holding system comprising the at least one device; and at least one holding element arranged at the free end of the rod of the at least one device, the at least one holding element being able to come into contact with the mechanical barrier.

19. The missile according to claim 11, further comprising at least one gorge capable of receiving the holding element when the rod of the at least one device assumes the final entry position (P3).

20. The missile according to claim 11, further comprising a plurality of holding systems.

* * * * *